US007335846B2

(12) United States Patent
Couvreur et al.

(10) Patent No.: US 7,335,846 B2
(45) Date of Patent: Feb. 26, 2008

(54) DEVICE FOR CONTROLLING A MOTORIZED SHUTTER

(75) Inventors: Jérôme Couvreur, Thorens-Glieres (FR); Dominique Dumaz, Sallanches (FR)

(73) Assignee: Somfy SAS, Cluses (FR)

( * ) Notice: Subject to any disclaimer, the term of this patent is extended or adjusted under 35 U.S.C. 154(b) by 41 days.

(21) Appl. No.: 10/520,097

(22) PCT Filed: Jul. 18, 2003

(86) PCT No.: PCT/IB03/03248

§ 371 (c)(1),
(2), (4) Date: Jan. 3, 2005

(87) PCT Pub. No.: WO2004/013880

PCT Pub. Date: Feb. 12, 2004

(65) Prior Publication Data

US 2005/0236261 A1 Oct. 27, 2005

(30) Foreign Application Priority Data

Jul. 30, 2002 (FR) ..... 02 09703

(51) Int. Cl.
*H01H 13/50* (2006.01)

(52) U.S. Cl. ..... 200/524; 200/523

(58) Field of Classification Search ..... 200/523–529, 200/530–546, 329
See application file for complete search history.

(56) References Cited

U.S. PATENT DOCUMENTS 4,877,931 A * 10/1989 Kawase et al. ..... 200/308
6,392,374 B1 5/2002 Menetrier et al. ..... 318/446

FOREIGN PATENT DOCUMENTS

| | | |
|---|---|---|
| DE | 2622229 | 12/1977 |
| EP | 1 182 321 | 2/2002 |
| EP | 1 182 321 A | 2/2002 |
| EP | 0 936 342 B1 | 5/2004 |
| FR | 1 025 384 | 4/1953 |
| FR | 2473221 | 7/1981 |

* cited by examiner

*Primary Examiner*—Elvin Enad
*Assistant Examiner*—M. Fishman
(74) *Attorney, Agent, or Firm*—Frommer Lawrence & Haug LLP; Ronald R. Santucci

(57) ABSTRACT

Disclosed is a device (30) for manually controlling the position of switching means which have two extreme positions A and C and an intermediate position B. Said device comprises a crank (5) and a crankpin (6). The invention is characterized by the fact that the device comprises a translationally movable sliding member (1) that has a neutral position and is provided with guideways (20, 21), within which the crankpin (6) is displaced. Said guideways allow the crankpin to be guided towards three areas of the sliding member, in which the position thereof is stable and which correspond to the three positions of the switching means, when the sliding member is moved towards the neutral position. The inventive device has the advantage of being simple while allowing a change in the state of the motor which operates the closing element, darkening element, or sun-shading element, or sun-shading element to be controlled by means of a single movement of a rod (14).

8 Claims, 7 Drawing Sheets

FIG. 12
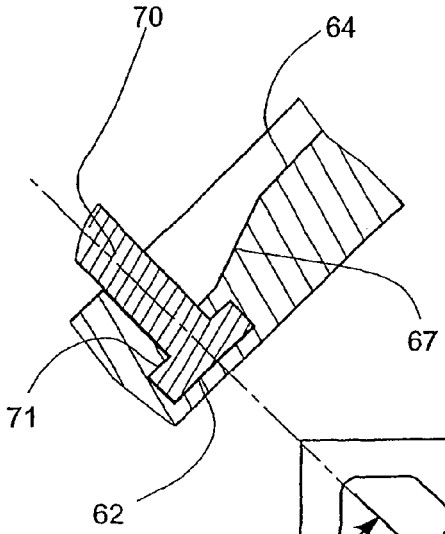
FIG. 13
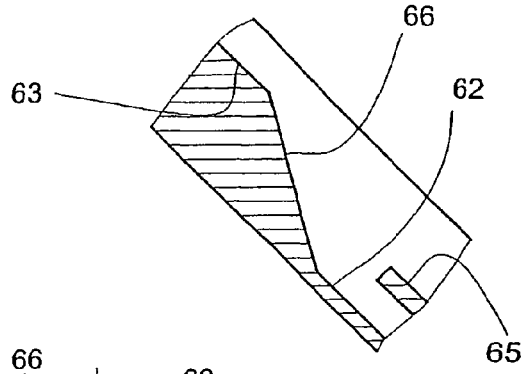
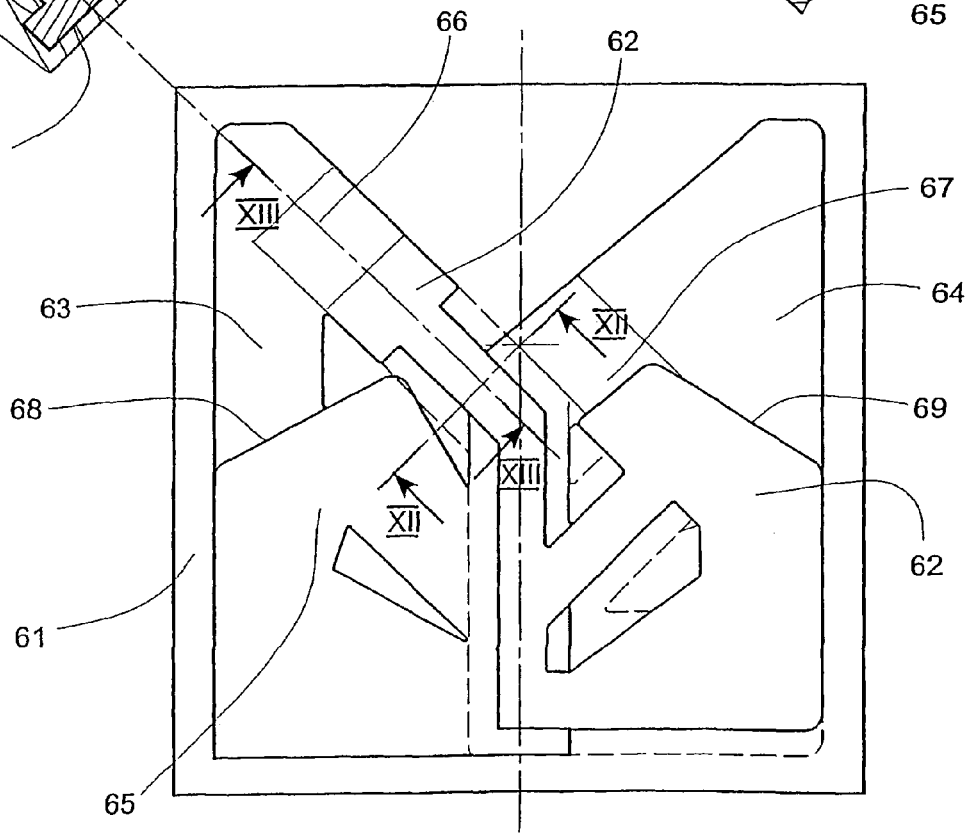
FIG. 11

DEVICE FOR CONTROLLING A MOTORIZED SHUTTER

BACKGROUND OF THE INVENTION

The present invention relates to a device for manual control of the position of switching means for the electrical powering of a motor for operating a closure, privacy or sun-protection element. It relates in particular to a process for control of a motor operated by means of such a device.

Two positions of the switching means allow the motor to be powered in order to turn it in a first direction of rotation and in a second direction of rotation, respectively. The third position of the switching means is a position in which the motor is not powered.

DESCRIPTION OF THE PRIOR ART

Patent application EP 0 936 342 discloses a control device comprising a switch controlling the power to a motor and means for actuating said switch. These actuating means consist of a bistable mechanical device that can occupy a first state in which the switch is closed and a second state in which the switch is open.

The bistable mechanism consists of a cylindrical component that can move in translation and in rotation in a fixed cylindrical tubular component to which it is connected by means of the action of a stud of the moveable component over a ramp of the fixed component. The moveable component is pushed toward the switch by a spring and is connected to a pulling member, which can be actuated manually, allowing the moveable component to be displaced counter to the action of the spring. The device is brought into its first state by means of an action on the pulling member, and is brought into its second state either by means of a second action on the pulling member or by means of a load moment exerted on the motor, giving rise to a relative rotary movement between the moveable component and the fixed component.

Similarly, application DE 26 22 229 discloses a bistable switch comprising a slider that can move in translation, in which a rod connected kinematically to electrical contacts is displaced.

Patent FR 1 025 384, discloses a device for electrical control of a motor for operating shutters and doors, allowing powering of the motor in one direction or in the other by means of a manual action, and the automatic stopping of the motor when the shutter or the door reaches an end-of-travel point. This device comprises a rotary three-phase reversing switch that can be placed in three positions corresponding to powering of the motor in two directions and to stopping of the motor. The operations of placing in the powering positions are carried out by virtue of two cables that drive the shaft of the switch carrying the contacts in rotation. The operation of placing in the position of stopping the motor may be carried out by means of an action on the cables in order to bring the switch into its intermediate position. When the door or the shutter arrives at the end-of-travel point, cams interact with levers in order to bring the shaft of the switch carrying the contacts into its intermediate position.

Furthermore, application FR 2 473 221 discloses a three-position electrical commutator comprising a slider that can move in translation in which a pin integral with a lever acting on electrical contacts is displaced. Successive actions on the slider move the commutator from a contact position into another position via a non-stable position in which there is no electrical contact.

Such embodiments present disadvantages. The first-mentioned embodiments do not allow the door or the shutter to be set in motion in one direction and then in the other direction by means of a single manual action.

The other embodiments allow this, but in one of the embodiments the actions have to be carried out on two different members, one allowing the rise and the other allowing the fall, and the architecture of this embodiment is complex, expensive and requires a great deal of space. Moreover, in the other embodiment, there is no intermediate position allowing stopping of the motorized element between the two contact positions.

Patent application FR 2 813 456 discloses a device for manual control of an electric motor for a roller shutter. It includes a plate integral with an electric motor. This plate has two housings, one receiving a barrel and one receiving a switch. A rod connected to a ring and passing through the wall of the plate makes it possible to turn the barrel by virtue of a ratchet-wheel system. The rotary movement of the barrel is converted by a connecting-rod/crank system into a translational movement of a slide, entraining the switch. When the roller shutter arrives at the end-of-travel point, means make it possible to return the switch into a position of equilibrium in which the motor is not powered.

This device presents drawbacks. Its numerous moving components make it complicated. Furthermore, when the shutter has arrived at the end-of-travel point, it is necessary to act twice on the rod in order to command it to displace itself in the opposite direction.

SUMMARY OF THE INVENTION

An object of the invention is to produce a manual-control device that palliates these drawbacks and improves known, prior-art devices. In particular, the invention proposes to produce a simple device that makes it possible, by means of a single action on a rod, to command a change in the state of the motor operating the closure, privacy or sun-protection element. Moreover, the device has to allow cutting off of the power to the motor when the entrained element arrives at the end-of-travel point.

DESCRIPTION OF THE DRAWINGS

By way of examples, the appended drawing shows two embodiments of the manual-control device according to the invention.

FIG. 11 is a front view of the slider of the control device according to a second embodiment.

FIGS. 12 and 13 are partial sectional views in planes XII-XII and XIII-XIII of the slider of the control device according to the second embodiment.

DESCRIPTION OF THE PREFERRED EMBODIMENTS

Figure 1:
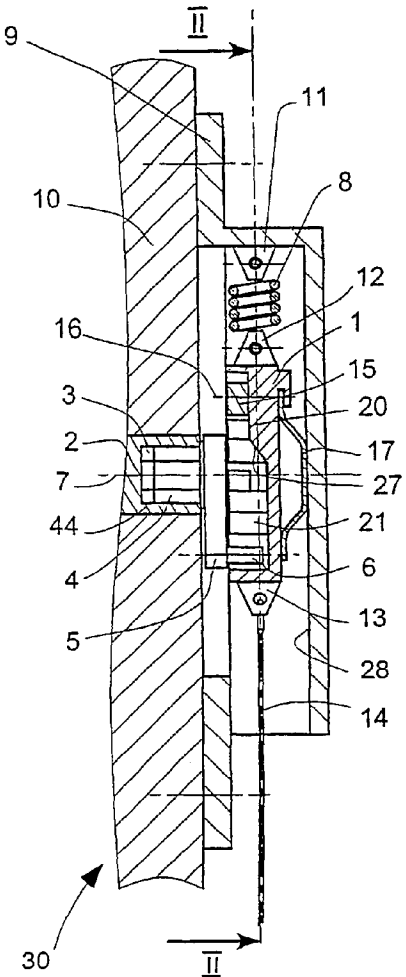
FIG. 1 is a sectional view of a first embodiment of the manual-control device according to the invention.

The control device, shown in FIG. 1, principally comprises a shaft 2 that can move in rotation in a bore 44 made in a structure 10 and connected in rotation at its end by a coupling 3 and 4 to a crank 5 ending in a crank pin 6 and a slider 1 that can move in translation in a sleeve 9 integral with the structure 10. This control device allows electrical powering of a motor entraining a load such as a shutter, a door or any other element.

Figure 4B:
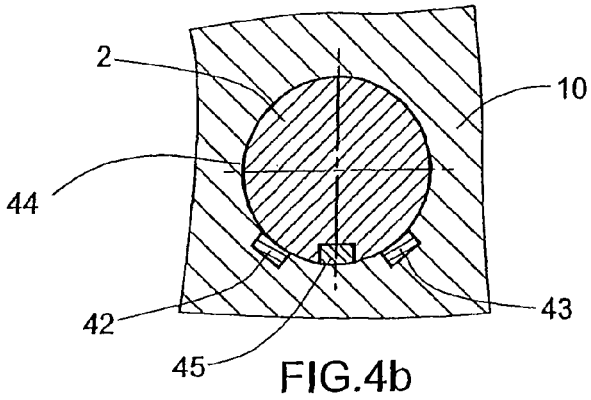
FIG. 4 is a cross-sectional view of the switching means.
Figure 4A:
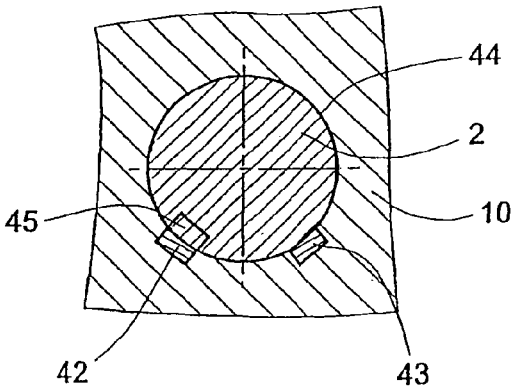
Figure 4C:
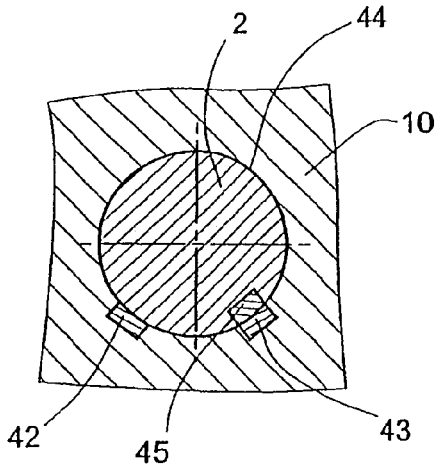

The shaft 2 and the structure 10 interact in order to produce means for switching the current upon rotation of the shaft 2 in the structure 10. As shown diagrammatically in FIG. 4, the shaft has terminals 45 along its longitudinal axis that are designed to come into contact with terminals 42 arranged axially in the bore 44, or with terminals 43 arranged axially in the bore 44, depending on the direction in which the shaft is turning. The position A, shown in FIG. 4*a*, in which the terminals 45 and 42 are in contact, allows closure of an electrical circuit so as to power the motor (not shown) in order to turn it in a first direction of rotation. The position C, shown in FIG. 4*c*, in which the terminals 45 and 43 are in contact, allows closure of an electrical circuit so as to power the motor in order to turn it in a second direction of rotation. The position B, shown in FIG. 4*b*, in which the contacts 45 are not in contact with any other, allows opening of the circuit powering the motor.

The shaft 2 has, at one of its ends, a hollow hexagonal form 3 receiving a crank 5 provided with a male hexagonal form 4 and with a crank pin 6. The shaft 2 and the crank 5 are connected in rotation by these complementary forms 3 and 4.

It is also possible for the shaft not to have any electrical contact and to consist of a simple transmission shaft, the purpose of which is to position a switch, for example a switch incorporated into the motor, as a function of the position of the crank pin 6 in the slider.

The slider 1 is in a sliding relationship in the sleeve 9. Its translation axis is perpendicular to the axis of rotation 7 of the shaft 2. The slider 1 and the sleeve 9 have, respectively, a lug 12 and a lug 11, each provided with a hole. The ends of a spring 8 allowing the slider 1 to be returned to the bottom of the sleeve 9 are articulated in these holes.

The slider 1 has another lug 13 opposite the lug 12. This lug 13, also, is provided with a hole by means of which, as shown in FIG. 3, it is possible, by means of a rod 14, to apply pulling forces to the slider 1 so as to displace it in translation counter to the action of the return spring 8.

The slider 1 is provided with tracks 20 and 21 in which the crank pin 6 is displaced. A leafspring 17 returns the slider 1 counter to the crank pin 6 so that the latter is permanently displaced to the bottom of the tracks 20 and 21. These tracks 20 and 21 have different levels relative to the axis of rotation 7 of the shaft 2.

Figure 3:
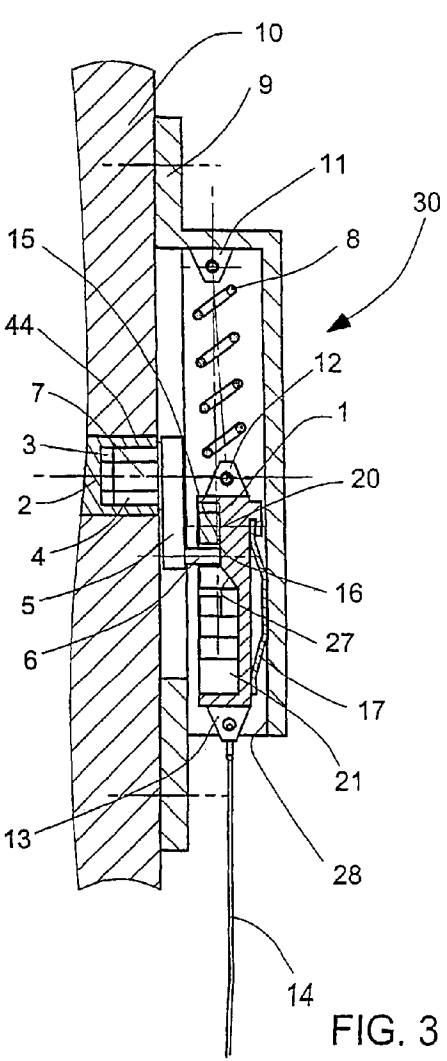
FIG. 3 is a view similar to that of FIG. 1, the slider being shown in another position.

The crank pin 6 is able to move from the lower level, into which it is displaced in FIG. 1, to the upper level, into which it is displaced in FIG. 3, by virtue of a ramp 27. In point of fact, when the crank pin is displaced in the lower track and arrives in contact with the ramp 27 by means of the displacement of the slider 1 through the effect of a pulling force on the rod 14, the action of the crank pin 6 contacting on the slider 1 pushes the latter back counter to the action of the spring 17. In this way, the crank pin 6 is able to scale the ramp 27.

Figure 2:
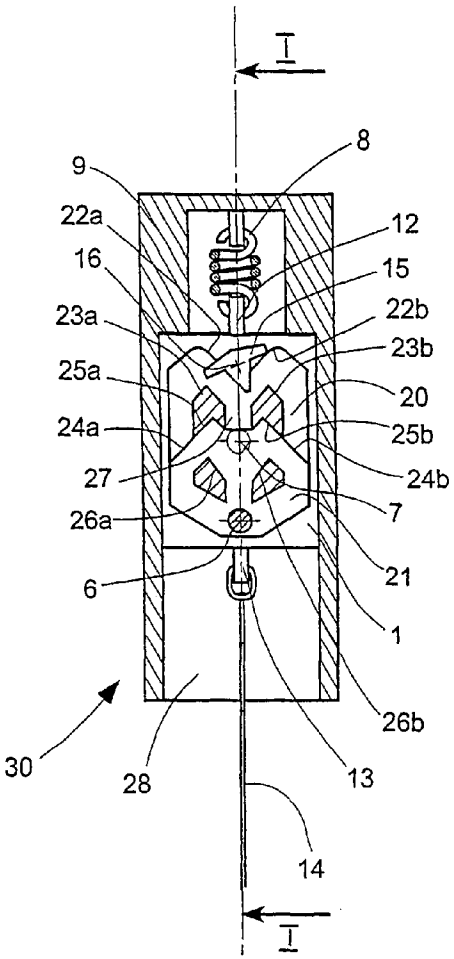
FIG. 2 is a sectional view in plane II-II of FIG. 1 of this embodiment.

The crank pin 6 is also able to move from the upper level, into which it is displaced in FIG. 3, to the lower level, into which it is displaced in FIG. 1, by virtue of the steps 24*a* and 24*b* shown in FIG. 2. In this case, it is the spring 17 that returns the slider 1 into a position in which the crank pin 6 is at the bottom of the track 21.

The slider 1 has a rocker 15 that can move in rotation about an axis parallel to the axis 7 of the shaft 2. This rocker 15 has two symmetrical stable positions relative to the axis of translation of the slider 1. It consists of two side arms and a central arm. As shown in FIG. 2, it allows the crank pin to be steered into the track A by virtue of the contact of the crank pin 6 on its central arm, and then it rocks into its other stable position when the crank pin 6 passes into the track A by means of contact of the crank pin 6 on its side arm closing off the track A. In this way, when the crank pin 6 next passes over the ramp 27, said crank pin will be steered into the track B.

The transverse displacements of the crank pin 6 in the tracks of the slider 1 give rise to rotations of the shaft 2 in the structure 10 so as to cause the motor to be powered in order to turn it in a first direction, or cause the motor to be powered in order to turn it in a second direction or to cause stopping of the motor. The slider comprises three zones a, b and c, shown in FIG. 5*b* and in FIG. 10, in which the crank pin occupies a position such that the switching means are in extreme positions A, C or intermediate position B.

Reference is now made to FIGS. 5*a* through 5*l*, which represent the path the crank pin 6 will follow at the time of three successive actions on the rod 14.

Figure 5A:
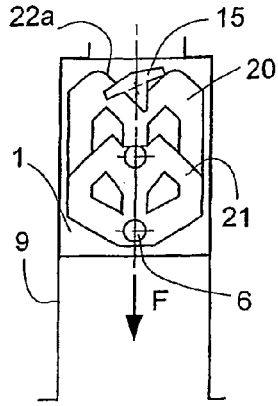
FIGS. 5*a* through 5*l* are diagrammatic views of the control device according to the first embodiment, shown in successive positions of the slider.

In FIG. 5*a*, the crank pin 6 is in its intermediate position B relative to its rocking movement about the axis 7 of the shaft 2. This position corresponds to the stopping of the motor. In this position, a pulling force F is applied to the slider 1 via the rod 14. This results in displacement of the slider 1 relative to the sleeve 9 and, consequently, the displacement of the crank pin 6 relative to the slider 1.

Figure 5B:
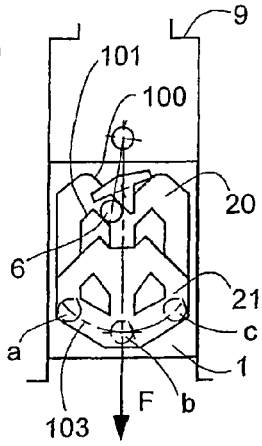

Through the action of this force F, the crank pin 6 passes over the ramp 27 and comes into contact with the central arm of the rocker 15, as shown in FIG. 5*b*.

Figure 5C:
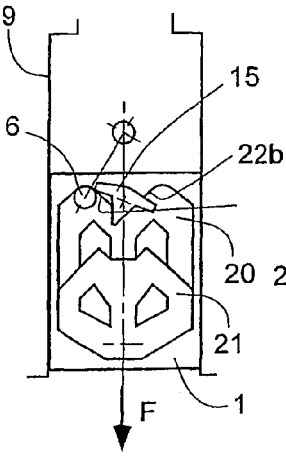

Still through the action of the force F, as shown in FIG. 5*c*, the crank pin 6 is displaced along a ramp 22*a* and causes the rocker 15 to rock into its other position of equilibrium. Once the crank pin 6 has arrived at the end of the ramp 22*a*, the pulling force F is stopped.

Figure 5D:
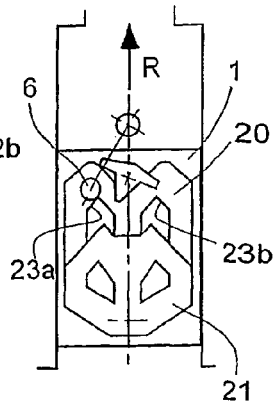
Figure 5E:
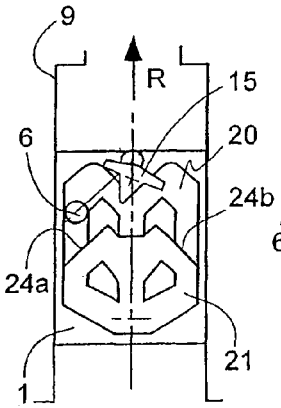

As shown in FIG. 5*d*, the slider 1 is entrained by the spring 8 exerting a return force R and resulting in the crank pin 6 coming into contact with the ramp 23*a*. The crank pin is displaced over this ramp 23*a* until it is located in the position shown in FIG. 5*e*.

Figure 5F:
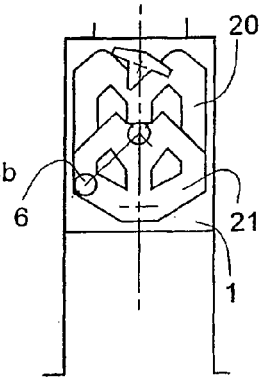

As the spring 8 is still applying a return force, the crank pin 6 is displaced, passing over the step 24*a* until it arrives in the stable position shown in FIG. 5*f*.

Figure 5G:
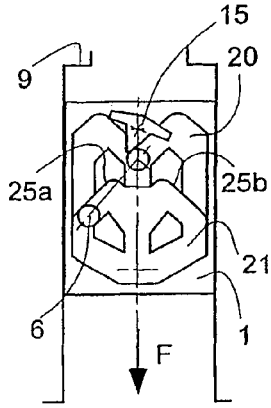
Figure 5H:
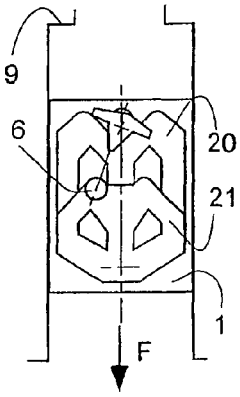

In this position, the motor is powered and rotates in a first direction of rotation. When it is desired to stop the motor, a pulling force F is again applied to the rod 14, as shown in FIG. 5*g*. The crank pin 6 then comes into contact against the step 24*a* and is displaced against the latter and then against the ramp 25*a* as far as its end, as shown in FIG. 5*h*. This step constitutes a means that makes it possible to permanently divert the crank pin steering toward the track above the step.

Figure 5I:
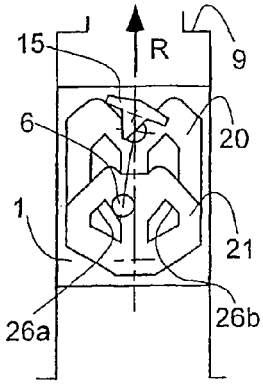
Figure 5J:
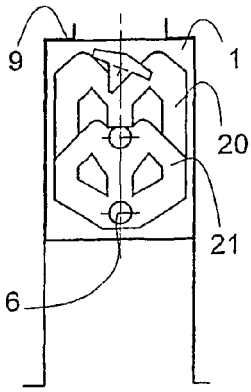

At this time, the pulling force is stopped, and through the effect of the return force R the crank pin comes into contact with the ramp 26*a* and is displaced along the latter, as shown in FIG. 5*i*.

Having arrived at the end of this ramp 26*a*, the crank pin 6 is located in its stable position of FIG. 5*a*. In this position, the motor is not powered.

Figure 5K:
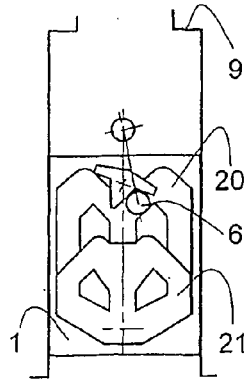

When a new pulling force F is applied to the slider 1 by means of the rod 14, the crank pin 6 again passes over the ramp 27 and comes into contact with the central arm of the rocker 15, as shown in FIG. 5*k*. At this time, the crank pin 6 will follow a path that is symmetrical, relative to the axis of sliding of the slider, to the path described for FIGS. 5*a* through 5*j*, resulting in different powering of the motor so as to turn it in a second direction of rotation.

Figure 5L:
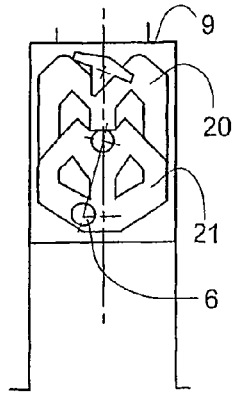

When the element entrained by the motor arrives at the end-of-travel point or at an obstacle, means known to a person skilled in the art make it possible to position the switching means in their "stop-motor" state. This is achieved by means of a rotation of the switching means about the axis 7 of the shaft 2 and results in the displacement of the crank pin 6 in the slider 1, as shown in FIG. 5*l*. The slider is consequently provided with a track 103 having substantially the shape of an arc of a circle, passing via the three stable positions of the crank pin in the slider. The crank pin is then located in a stable position, shown in FIG. 5*j*.

In this embodiment, the tracks define three stable positions that may be occupied by the crank pin when the slider is returned toward its position of rest and that correspond to the three positions of the switching means. These tracks have substantially the form of inverted Vs: a first wing 100 of the V serving to displace the crank pin transversely relative to the slider when the latter is displaced in a first direction, and the second wing 101 serving to displace the crank pin transversely relative to the slider in the same direction when it is displaced in the other direction.

According to the nature of the switching means and, in particular, as a function of their ability to remain stable in a position into which they have been brought, the ends of these tracks may or may not have means for holding the crank pin in position at the end of the track. These means may, for example, consist of dishes 102, such as those shown in FIG. 10. The crank pin comes to be positioned in said dishes when it arrives at the end of the track.

The slider could also be returned into its position of rest by forces other than that of an elastic element. In particular, it could be returned under its own weight or by means of an action on the part of the user via the rod.

Figure 6:
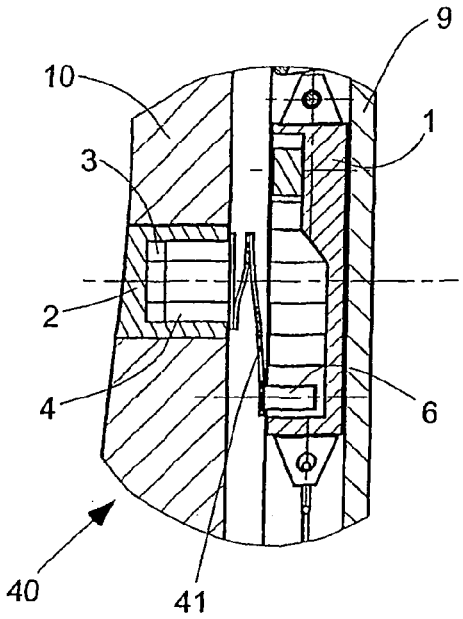
FIGS. 6 and 7 are sectional views of the control device according to a first variant of the first embodiment, the slider being shown in two positions.
Figure 7:
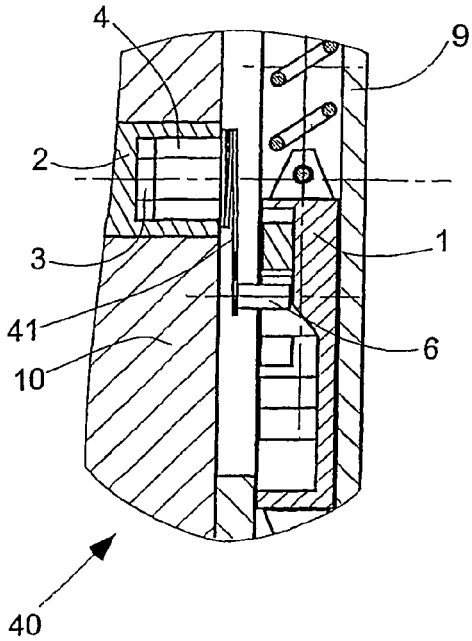

A first variant of this embodiment is shown in FIGS. 6 and 7. The control device 40 shown in these figures differs from the device described above in that the slider 1 is not returned into contact with the crank pin. In fact, in this case, it is the crank 41 that is formed from elastic leaves allowing the crank pin 6 to be returned to the bottom of the tracks of the slider 1.

Figure 8:
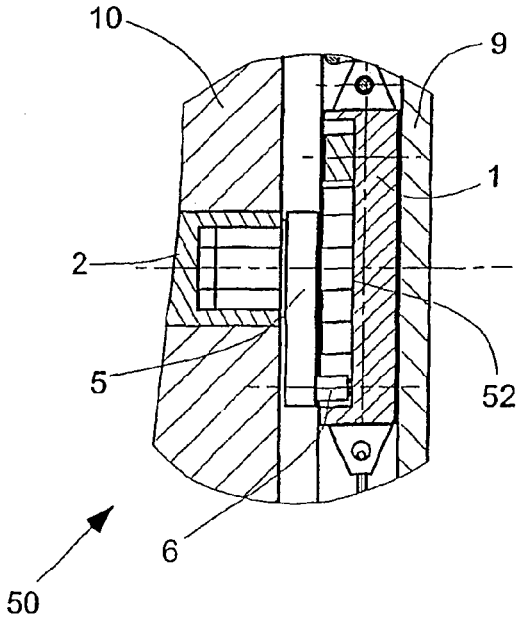
FIG. 8 is a sectional view of the control device according to a second variant of the first embodiment.
Figure 9:
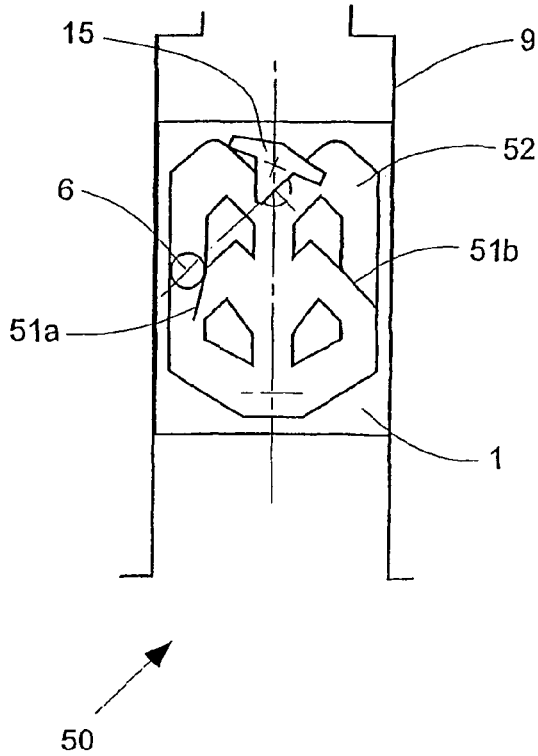
FIG. 9 is a diagrammatic view of the control device according to this second variant.

A second variant of this embodiment is shown in FIGS. 8 and 9. The control device 50 shown in these figures differs from the devices described above in that the tracks 52 of the slider 1 have only one level. Consequently, means for returning the crank pin 6 and the tracks 52 relative to one another are no longer necessary.

However, flaps 51*a* and 51*b* articulated about horizontal axes and consisting of tabs produced from an elastic material are added into the tracks 52. They are designed to replace the steps 24*a* and 24*b* of the devices described above. In effect, these flaps 51*a* and 51*b* allow the displacement of the crank pin in only one direction in the two vertical side channels of the slider 1 shown in FIG. 9. It should be noted that the tabs may also be articulated about axes parallel to the bottom of the tracks 52. These tabs constitute means that make it possible to permanently divert the crank pin steering toward the tracks located above the tabs.

Figure 10:
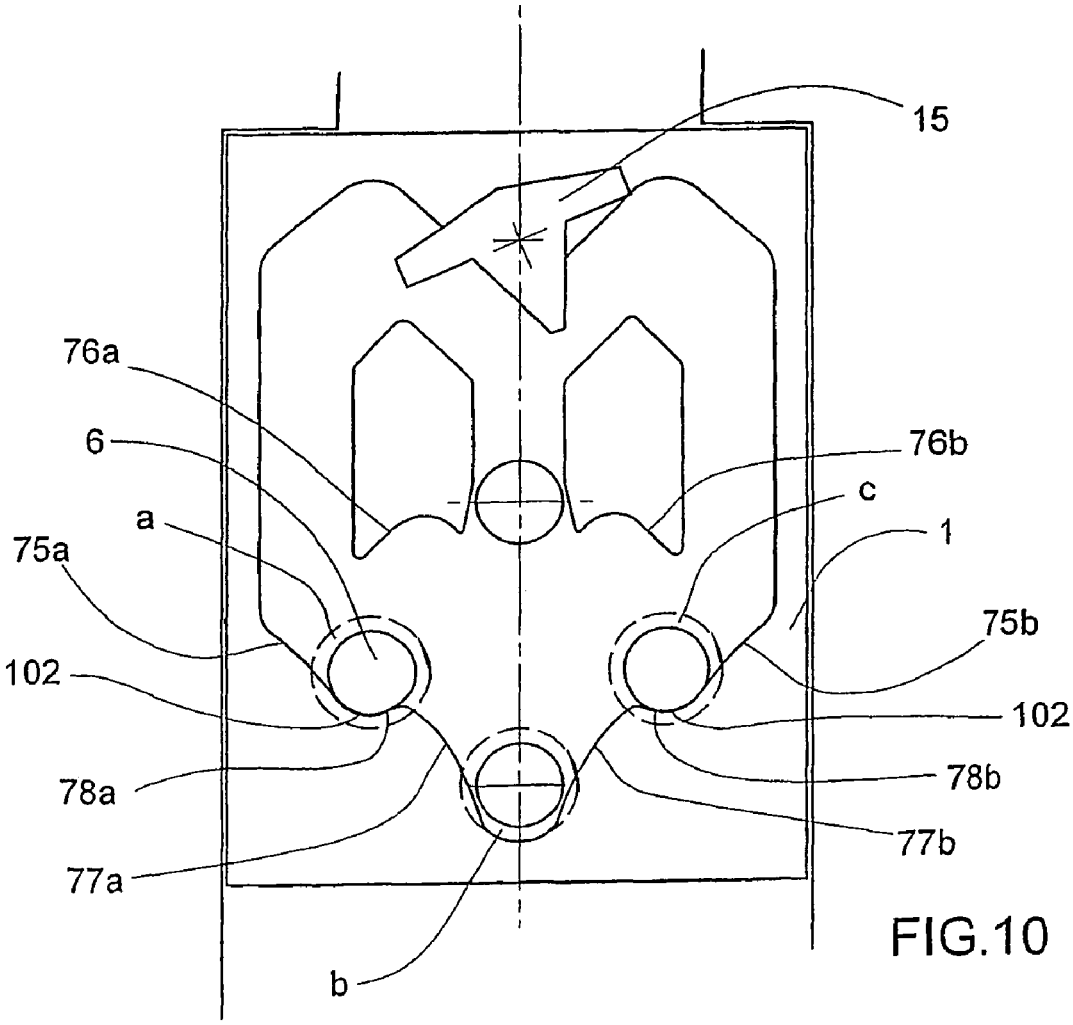
FIG. 10 is a diagrammatic view of the control device according to a third variant of the first embodiment.

A third variant of this embodiment is shown in FIG. 10. The slider 1 of the control device shown in this figure differs from the slider described above in that it has no flap. However, it has ramps 75*a* and 75*b* that make it possible, after having applied a force to the slider 1, to bring the crank pin 6 into a stable position such that when there is further action on the slider 1 the crank pin 6 comes into contact with one of the ramps 76*a* or 76*b* and then into contact with one of the ramps 77*a* or 77*b* so as to bring it into its stable position corresponding to the stopping of the motor.

When the crank pin 6 is in its stable position allowing powering of the motor and the element entrained by the motor arrives at the end-of-travel point, the switching means are brought into their "stop-motor" position, and the crank pin 6 acts on the ramp 78*a* or on the ramp 78*b* and displaces the slider 1 counter to the action of the return spring 8 in order to escape from its "power-motor" position of equilibrium.

The slider 61 and the crank pin 70 of a second embodiment are shown in FIGS. 11 to 13. This crank pin 70 differs from the crank pin of the devices described above in that it has a shoulder 71. The slider 61 differs from the sliders described above in that the tracks have three levels: a track 62 at a lower level, two tracks 63 and 64 at an upper level, and a track 65 at an intermediate level. The slider 61 has a ramp 66 allowing the crank pin 70 to move from the track 62 to the track 63, and a ramp 67 allowing the crank pin 70 to move from the track 65 to the track 64. The slider 61 has a step 68 allowing the crank pin to move from the track 63 to the track 65, and a step 69 allowing the crank pin 70 to move from the track 64 to the track 62.

The operating principle of a device of this type is explained with reference to diagrams 14*a* through 14*i*.

Figure 14A:
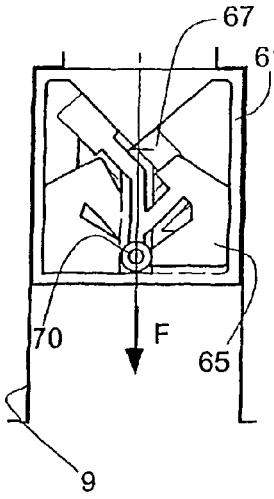
FIGS. 14*a* through 14*j* are diagrammatic views of the control device according to the second embodiment, shown in successive positions of the slider.
Figure 14B:
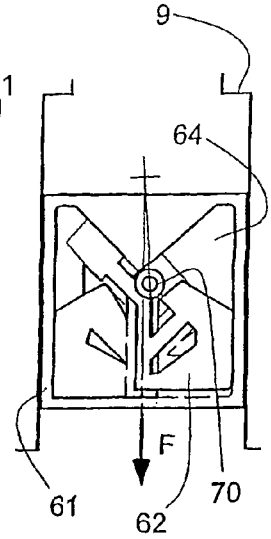
Figure 14C:
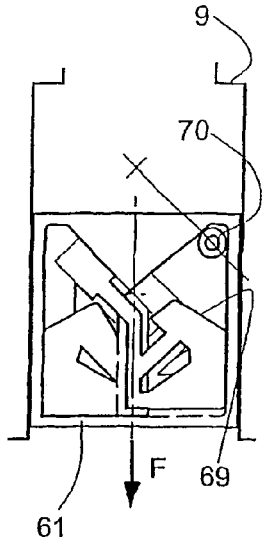
Figure 14D:
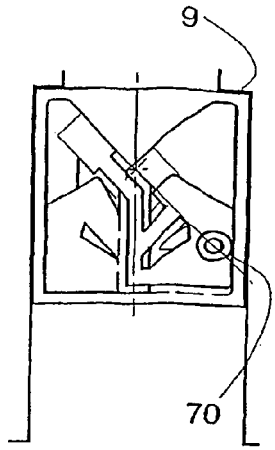
Figure 14E:
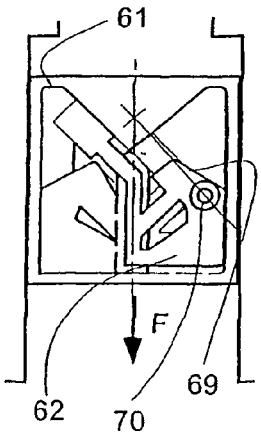
Figure 14F:
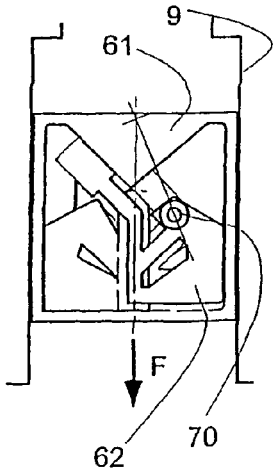
Figure 14G:
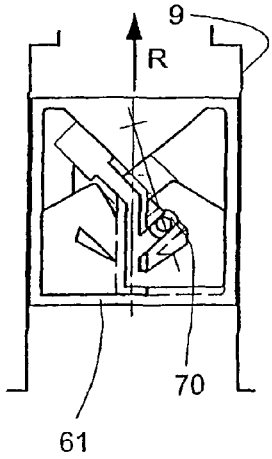

In FIG. 14*a*, the crank pin 70 is in contact with the track 65. After action on the slider 61, it is displaced and passes over the ramp 67, and is displaced transversely until it arrives in the position shown in FIG. 14*c*, in which the motor is powered in order to turn in a first direction of rotation. The action of the return spring then brings the crank pin into a stable position shown in FIG. 14*d*.

Figure 14H:
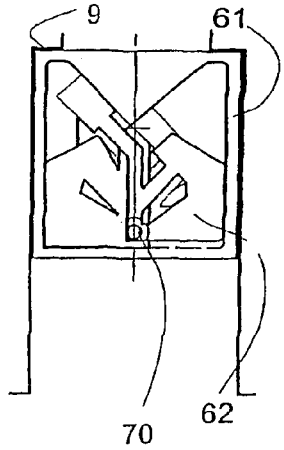
Figure 14I:
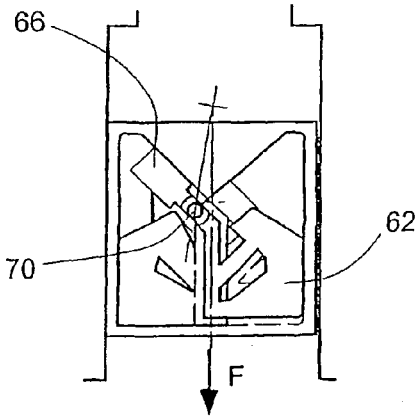
Figure 14J:
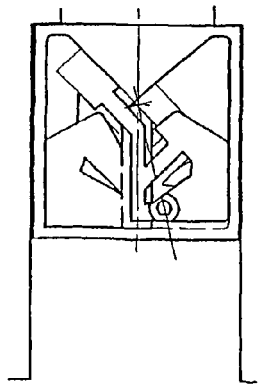

A further action on the slider 61 allows the crank pin 70 to be brought into a position of equilibrium, shown in FIG. 14*h*, in which the motor is not powered. The crank pin is then in contact with the track 62. A further action on the slider 61 makes it possible, as shown in FIG. 14*i*, to steer the crank pin toward the ramp 66 and to displace the crank pin 70 transversely so as to power the motor in order for it to turn in a second direction of rotation.

It should be noted that the shaft 2 that can move in rotation in the structure 10 may be stable in the three "power motor in a first direction", "power motor in a second direction" and "stop-motor" positions. In such a case, when it is in a position in which the motor is powered, a force of the slider on the crank pin is necessary in order to rock it into the position in which the motor is stopped. In such a case, use may be made of a slider that is not returned into a position of rest. It is then necessary to effect a back-and-forth movement with the rod in order to change the position of the switch.

The invention claimed is:

1. A device for manual control of the position of switching means having two extreme positions A and C and an intermediate position B, provided with a crank comprising a crank pin and controlling the electrical powering of a motor for operating a closure, privacy or sun-protection element, which device comprises a slider that can move in translation, has a specific rest position and is provided with tracks in which the crank pin is displaced, and wherein, when the slider is displaced toward its specific rest position, the tracks allow the crank pin to be guided toward three zones (A, B and C) of the slider so that the crank pin can reach three distinct stable positions for the same specific rest position of the slider, these three distinct stable positions corresponding to the three positions of the switching means (A, B, and C).

2. The manual control device (30; 40; 50) as claimed in claim 1, wherein the slider comprises a track allowing the displacement of the crank pin when the switching means are displaced from one of said positions toward another.

3. The manual control device as claimed in claim 1, wherein the slider has at least one means for allowing the movement of the crank pin from a first track to a second track via/through said at least one means and for prohibiting the movement of the crank pin from the second track to the first track via/through said at least one means.

4. The manual control device according to claim 3, wherein said means comprises an elastic tab.

5. The manual control device according to claim 4, wherein said elastic tab is articulated about an axis parallel to the bottom of the tracks.

6. The manual control device as claimed in claim 3, wherein the means allowing the movement of the crank pin from a first track to a second track and for prohibiting the movement of the crank pin from the second track to the first track comprises a ramp and steps creating tracks having a plurality of levels as compared to the direction of the axis of the crank pin and means for returning the crank pin to the bottom of these tracks.

7. The manual control device as claimed in claim 6, wherein the slider comprises tracks interacting with the crank pin having a shoulder for constituting a circuit that makes it possible to bring the switching means into the following positions by means of successive actions on the slider: intermediate position B; first extreme position A; intermediate position B; second extreme position C; intermediate position B.

8. A process for manual control of the position of switching means of a device as claimed in claim 1, wherein, by means of successive actions on the slider, the switching means are displaced into the following stable positions: intermediate position B; first extreme position A; intermediate position B; second extreme position C; intermediate position B.

* * * * *